US005464080A

United States Patent [19]

Liang

[11] Patent Number: 5,464,080

[45] Date of Patent: Nov. 7, 1995

[54] UNIVERSALLY PIVOTAL LUGGAGE STEERING APPARATUS

[76] Inventor: Joseph Liang, P.O. Box 1060, Alpine, N.J. 07620

[21] Appl. No.: 99,215

[22] Filed: Jul. 29, 1993

[51] Int. Cl.[6] ..... A45C 5/14; A45C 13/26

[52] U.S. Cl. ..... 190/18 A; 190/39; 190/115; 280/37

[58] Field of Search ..... 190/115–118, 39, 190/18 A; 280/37, 47.315, 47.371, 355.1

[56] References Cited

U.S. PATENT DOCUMENTS

| | | | |
|---|---|---|---|
| 1,616,632 | 2/1927 | Mastrontonio | 190/18 A X |
| 2,392,926 | 1/1946 | Kelly | 190/18 A X |
| 2,665,139 | 1/1954 | Schroeder | 280/47.371 X |
| 4,795,186 | 1/1989 | Tyus | 280/37 X |
| 4,838,396 | 6/1989 | Krenzel | 190/115 X |
| 4,966,259 | 10/1990 | Bergman | 190/117 X |
| 5,048,649 | 9/1991 | Carpenter et al. | 190/115 X |
| 5,178,244 | 1/1993 | Liang | 190/18 A |

FOREIGN PATENT DOCUMENTS

| | | | |
|---|---|---|---|
| 2661807 | 11/1991 | France | 190/18 A |
| 2253358 | 5/1974 | Germany | 190/18 A |
| 2030966 | 4/1920 | United Kingdom | 190/18 A |

*Primary Examiner*—Sue A. Weaver
*Attorney, Agent, or Firm*—Cohen, Pontani, Lieberman & Pavane

[57] ABSTRACT

A steering apparatus for steering an article of luggage, such as a suitcase, as it is pulled on and along an underlying support surface in a desired direction. An elongated member is connected to the suitcase via a ball and socket arrangement and a handle is rotatably mounted to the distal end of the member. The handle is manipulatable in and into a plurality of positions to omnidirectionally rotate the ball relative to the socket and thereby steer the article in a particular direction. In the preferred embodiment, the member is formed of an elongated arm and a relatively shorter connecting member that extends from the ball and is pivotally connected to the arm upon which the handle is mounted. The arm may, in turn, be formed of a pair of telescoping rods.

16 Claims, 3 Drawing Sheets

FIG. 4
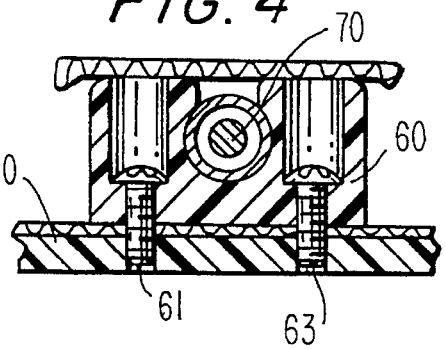
FIG. 5
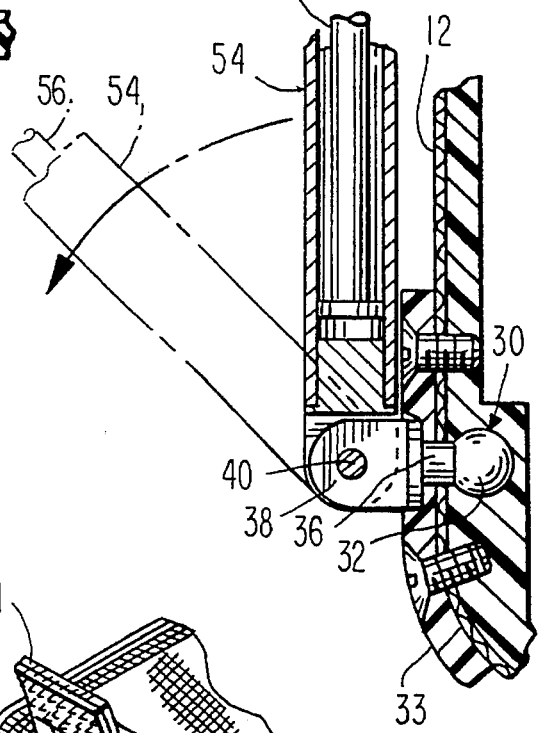
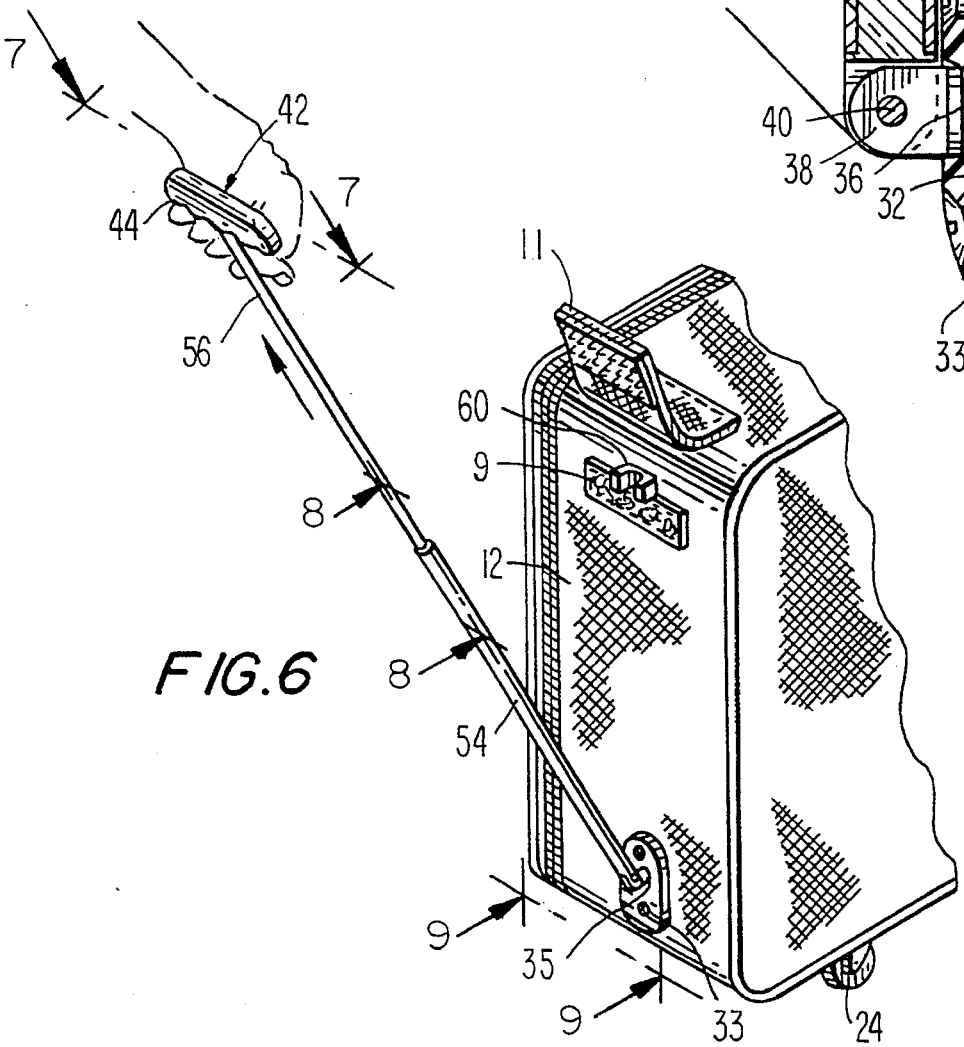
FIG. 6

UNIVERSALLY PIVOTAL LUGGAGE STEERING APPARATUS

FIELD OF THE INVENTION

The present invention is directed to a universally pivotable, user-adjustable steering mechanism for wheeled or slidable articles of luggage which provides enhanced directional control as the luggage is pulled by a person wishing to steer the luggage in a particular direction on and along an underlying support surface.

BACKGROUND AND OBJECTS OF THE INVENTION

A person who has ever travelled, or otherwise attempted to manipulate a large and/or heavy piece of luggage, recognizes the difficulties involved in steering or directing such luggage in a desired and typically varying direction. Previous attempts to solve this problem, such as through the inclusion of wheeled casters and metal sliders located on the bottom of the luggage, as well as pull handles and straps attached to the front of the luggage, have offered some degree of improved maneuverability. However, generally such pull handles and straps are either flexible or connected to the luggage via a flexible member that is typically secured to the front of the luggage proximate the top and which cannot effectively support the luggage during turns, often causing or permitting the luggage to tip over. Further, although some prior art luggage steering apparatus arrangements include a handle mounted on a rigid rod that is, in turn, attached to the luggage to be pulled by a user, such steering arrangements lack the capability of rotation with respect to the direction in which the luggage is being pulled and, therefore, make it difficult to effectively guide the luggage in a desired direction without undue difficulty.

In addition to the aforementioned drawbacks of the prior art, such known luggage steering arrangement also require that the user impart to the luggage not only a pulling force but, in addition, a rotative force in order to direct the luggage along a curved path or through a desired change in direction.

It is, therefore, an object of the present invention to provide an article of luggage incorporating a steering mechanism or arrangement that permits the article to be pulled by a user who applies only a pulling force to the article, thereby greatly facilitating ease of steering.

It is also an object of the present invention to provide a steering mechanism attached to an article of luggage on the front and proximate the bottom so that the point of attachment is below the center of gravity of the article of luggage, thereby increasing stability and reducing tippage of the article as it is steered along a non-straight path.

It is a further object of the present invention to provide a steering mechanism having an extendable and retractable member with an attached handle for easily manipulating the steering mechanism into a plurality of positions so as :to steer the article of luggage in a desired direction.

It is a still further object of the present invention to provide a steering mechanism that may be easily retracted and stored in a position substantially parallel with and along the front of the article of luggage during periods of nonuse.

SUMMARY OF THE INVENTION

Broadly speaking, the present invention provides an apparatus for steering an article of luggage, such as a suitcase, as the suitcase is pulled by a user on and along an underlying support surface in a desired direction. The apparatus includes a socket on the front of the suitcase and proximate tile article bottom; a ball disposed within the socket for omnidirectional rotation relative to tile socket; an elongated member depending from the ball; and a handle carried on a distal end of the member opposite the ball and graspable by a user for applying to the suitcase a pull force concentrated at tile lower front of tile suitcase so as to advance the suitcase along an underlying support surface while steering tile suitcase through selective user-controlled manipulation of the handle to correspondingly move the member and rotate the ball in and relative to the socket and thereby selectively directionally vary the pull force applied to the suitcase for moving tile suitcase in a user-selected desired direction, the handle being rotatable relative to the member about an axis defined by the elongation of the member.

In the preferred embodiment, tile apparatus also includes retaining means on the front and proximate the top of the suitcase for releasable engagement with at least one of the handle and the member to secure the member to tile front of the suitcase when tile steering apparatus is not in use.

Also in tile preferred embodiment, tile member is comprised of a first and a second rod in telescoping relation with each other and rotatable with respect to each other for enabling user-controllable longitudinal extension and contraction of the member.

The foregoing as well as additional details of the present invention will be more fully apparent from the following detailed description and annexed drawings of the presently preferred embodiments thereof.

BRIEF DESCRIPTION OF THE DRAWINGS

FIG. 4 is a sectional view taken along the lines 4—4 in FIG. 1;

FIG. 5 is a sectional view taken along the lines 5—5 in FIG. 1 and showing the ball and socket maneuvering arrangement of the invention;

FIG. 6 is an elevated perspective view, partly broken away, of the steering apparatus of FIG. 1 shown in its extended position;

DETAILED DESCRIPTION OF THE PREFERRED EMBODIMENTS

Figure 1:
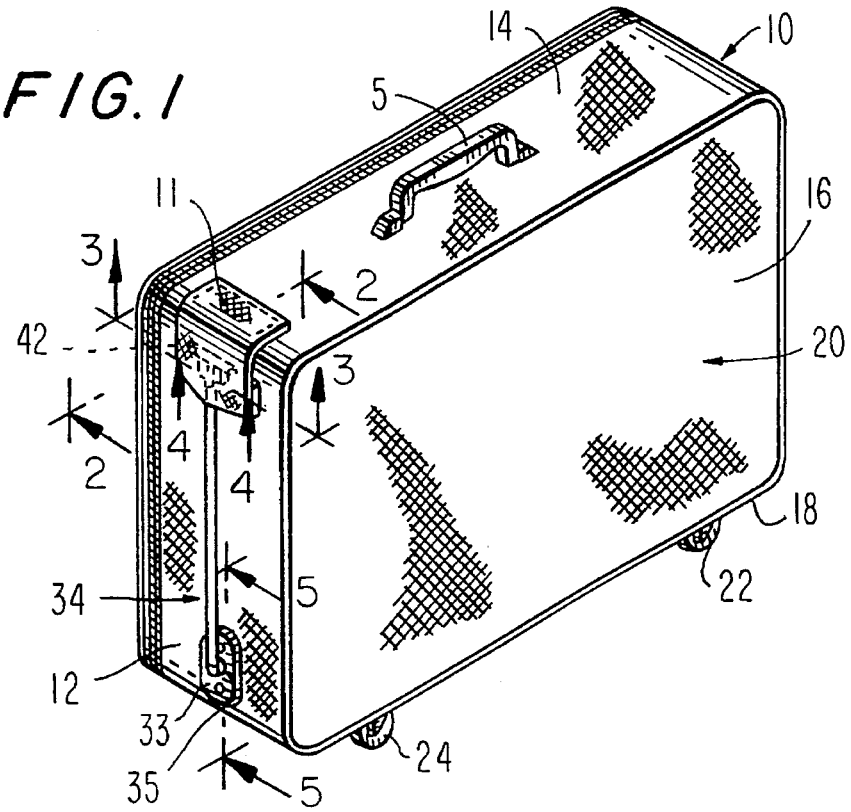
FIG. 1 is an elevated perspective view of a steering apparatus for an article of luggage constructed in accordance with the present invention.
Figure 2:
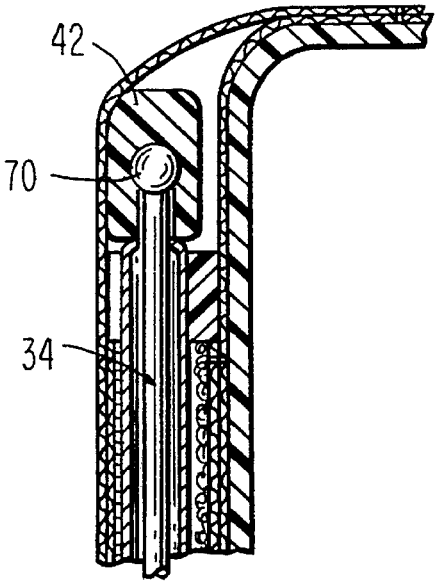
FIG. 2 is a sectional view taken along the lines 2—2 in FIG. 1.
Figure 3:
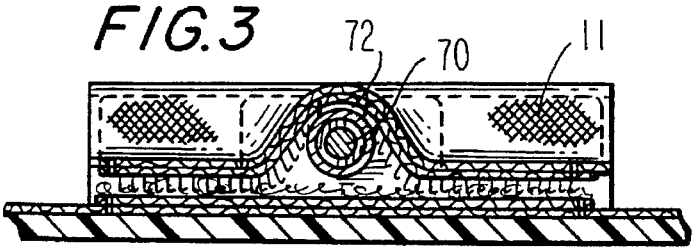
FIG. 3 is a sectional view taken along the lines 3—3 in FIG. 1.

Referring now to the drawings, and initially to FIG. 1, an article of luggage such as a suitcase 10 is shown as having a front 12, a top 14 carrying a conventional handle 5, side walls 16, and a bottom 18, which together define a closeable compartment 20 for the containment of various items or articles. Mounted on or otherwise affixed to or adjacent the front 12 of the suitcase 10 is a steering apparatus constructed in accordance with tile teachings of the present invention, as more fully described below. The suitcase 10 is depicted as having, on the bottom 18 (which is shown facing the underlying support surface along which the suitcase 10 may be pulled), a pair of front wheel casters 24 and a pair of orientationally-fixed rear wheels 22, the front casters 24 preferably being freely and omnidirectionally pivotable to follow the desired direction of travel of tile suitcase 10 as it is pulled by a user. The inclusion and/or particular configuration and/or location of the casters 24 and/or rear wheels 22 as illustrated in tile drawings is not, however, critical to the invention and the suitcase 10 may, alternatively and by way of example, be configured with two rear wheels and one rotatable forward caster, two rotatable forward casters and a single rear wheel, or other combinations of casters and fixed-orientation wheels. As a further alternative, tile suitcase 10 may (in lieu of wheels) be provided with reduced friction elements or surfaces such as pads or projections coated with a low friction surface material such as Teflon, nylon, etc. for allowing the suitcase 10 to be freely pulled along the support surface.

Referring next to FIGS. 1, 5 and 6, tile steering apparatus of the invention will now be described. As shown, the front 12 of suitcase 10 has a preferably interiorly recessed area containing or defining a socket 30 which is concealed by a protection plate 33 having a hole 35 in its center. The socket 30 is positioned proximate the bottom 18—i.e. below the center of gravity of the suitcase 10—for captively retaining and containing the ball-shaped end 32 of a member 34 that passes through the hole 35. The free end of the member 34 carries a handle 42 mounted thereon and capable of being rotated about the longitudinal axis of the member 34. Member 34 is shown comprised of a first elongated rod 54 in telescoping relation with a second elongated rod 56 upon which the handle 42 is rotatably mounted, thereby allowing the member 34 to be contracted in length during periods of nonuse of the apparatus and suitably extended when the apparatus is in use. First rod 54 and second rod 56 are interconnected in a manner described more fully below and are capable of being relatively rotated about their common longitudinal axis. In addition, as the handle 42 is preferably rotatably mounted on the second rod 56 and since the first rod 54 is rotatable, via ball-shaped end 32, within the socket 30 proximate bottom 18 little, if any, torque will be applied to the suitcase 10 by a user angularly or otherwise pulling and steering the suitcase. Accordingly, suitcase 10 can be steered in an efficient manner of enhanced comfort to the user and will not be highly susceptible to tipping when being steered along a curved or tortuous path.

Figure 11:
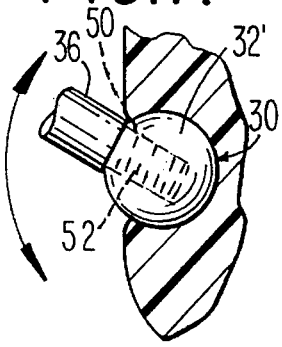
FIG. 11 is a sectional view of an alternate embodiment of the invention showing a friction-fit securement of the connecting member and the ball.

Referring now to FIG. 5, an embodiment of the invention is shown as having the ball-shaped end 32 integrally formed with a relatively short connecting member 36 which, in turn, is hingedly secured via a pin 40 to an end of the first rod 54 via a pivotal hinge 38. As an alternative to the integrally formed connecting member 36 and ball-shaped end 32, and referring now to FIG. 11, the ball 32' may include a bore or opening 50 for accommodating an inserted end of the connecting member 36 in a friction fit 52 (or an adhesively or otherwise attained engagement) for securing the ball 32' to the connecting member 36. In addition and as shown in FIGS. 4 and 6, the suitcase 10 is provided with a retaining means such as a clip 60 or the like mounted via screws 61 and 63 on the front 12 proximate the top 14 and at a suitable spacing from the ball 32 for releasable engagement with at least one of the member 34 and handle 42. Thus, when the apparatus is not in use and the member 34 is in its contracted position (i.e. the second rod 56 is disposed substantially fully within the first rod 54), the connecting member 36 spaces the first rod 54 from the front 12 so that the first rod 54 may be pivoted about the pivotal hinge 38 and releasably secured to the clip 60, thereby securely stowing the apparatus along and substantially parallel to the front 12 during periods of nonuse. Once so secured, the handle 42 may be concealed by a flap 11 which is sewn on one end to the top 14 and which contains releasable loop and hook type fasteners on the other end for mating with loop and hook type fasteners 9 fastened to the front 12 of suitcase 10.

Figure 8:
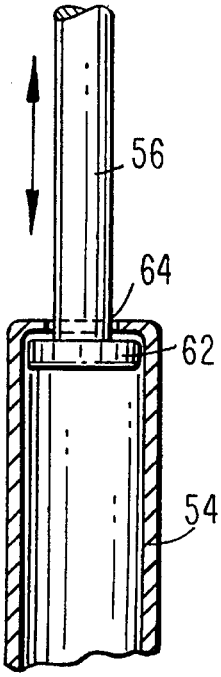
FIG. 8 is a sectional view taken along the lines 8—8 in FIG. 6, partly broken away, showing the telescoping relationship of the first and second rods of one embodiment of the inventive steering apparatus.

As explained above, the second rod 56 is disposed in telescoping relation with and concentrically within the first rod 54 in the manner depicted in FIG. 8. The diameter of the second rod 56 is slightly less than the diameter of the first rod 54 so as to permit and facilitate the intended slidable and rotative movement of the second rod 56 with respect to the first rod 54. Suitable structure may also be provided for permitting the rods 54, 56 to be selectively retained in intermediate positions of extension between their fully extended and fully contracted positions. As shown, one end of the second rod 56 is provided with a retaining lip 62 and one end of the first rod 54 contains a corresponding obstruction 64 for captively maintaining the lip 62 within the first rod 54 when the apparatus is fully extended, thereby ensuring that the first rod 54 remains interengaged with the second rod 56. While this configuration is preferred, it should be apparent that the opposite configuration can also be employed, i.e. the diameter of the first rod 54 may be slightly less than the diameter of the second rod 54, and/or the end of the first rod 54 may be formed with a retaining lip with the end of the second rod 56 containing an obstruction to secure the retaining lip therewithin. In the,currently preferred embodiment, the ball 32, first rod 52, second rod 54 and connecting rod 36 may be manufactured of a lightweight metal or durable plastic material.

Figure 7:
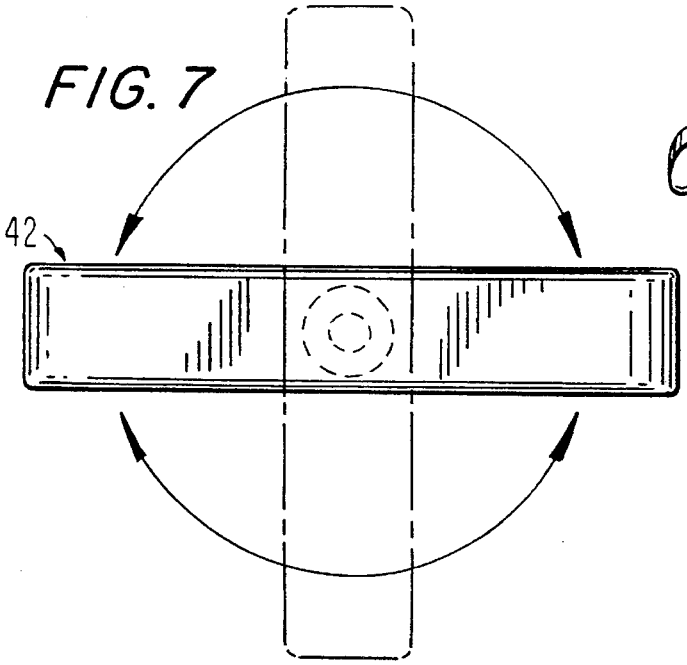
FIG. 7 is a top plan view of the handle of the inventive steering apparatus showing rotational movement thereof.
Figure 10:
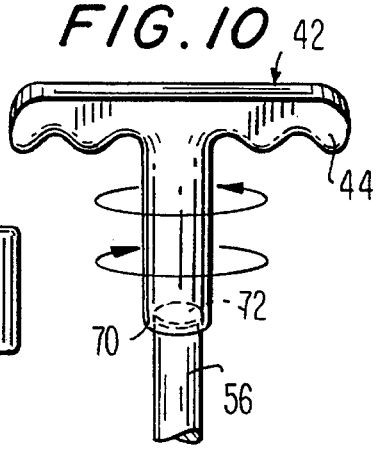
FIG. 10 is a sectional view, partly broken away, of the steering apparatus handle showing the rotation of the handle relative to tile elongated arm.
Figure 9:
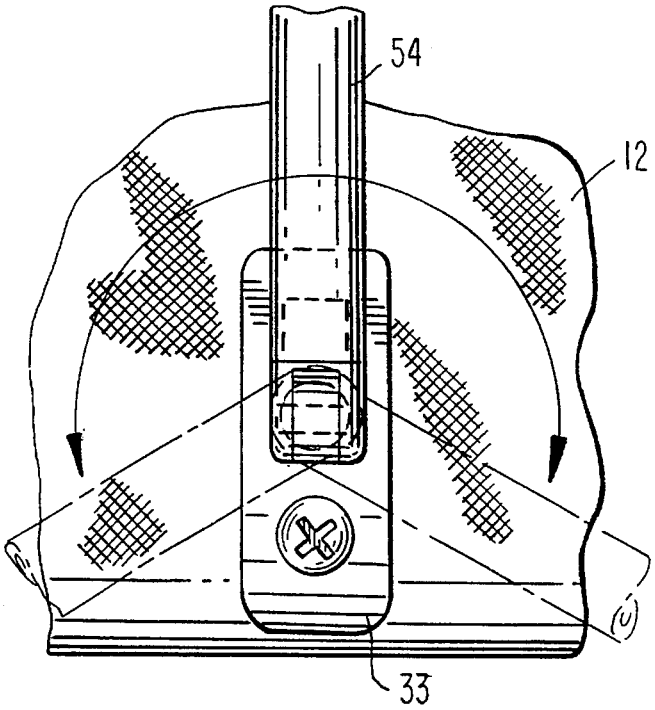
FIG. 9 is a front sectional view taken along the lines 9—9 in FIG. 6, partly broken away, of the lower portion of the inventive steering apparatus showing tile omnidirectional movement of the elongated member of the apparatus relative to the suitcase.

With reference now to FIG. 10, the handle 42 is fabricated so as to have an outer portion 44 configured for easy grasping and retention by the user. It should be noted, however, that the handle 42 may alternatively be configured as a circular knob, or as a circular or non-circular ring, or in any other suitable shape or form. The inner portion of the handle 42 contains a handle-securing ridge 70 configured for rotatable mounting about a second retaining lip 72 located on the end of the second rod 56 opposite that carrying the lip 62. Thus, as shown in FIG. 7 and as should by now be apparent, handle 42 is rotatable about the longitudinal axis defined by the second rod 56, and the second rod 56 is likewise rotatable with respect to the first rod 54. In addition, and as shown in FIGS. 5, 6 and 9, the captively interengaged ball 32 and socket 30, in conjunction with the pivotal hinge 38, allow for the selective manipulation of the handle 42 in and into a virtually limitless plurality of positions, thereby accommodating any particular user's height and/or variations in the elevation and/or orientation of the underlying support surface 11, while simultaneously allowing the suitcase 10 to be easily and conveniently steered in any desired direction. Furthermore, the preferred positioning of the socket 30, which is located below the center of gravity of the suitcase 10, notably enhances the stability of the device in that the possibility that the suitcase 10 will tip or fall over while being steered is significantly reduced.

Although I have herein shown, described and pointed out several preferred embodiments of the invention, various changes and modifications will be readily apparent to those of ordinary skill in the art who read the foregoing description. For example, the telescoping first and second rods described above may be replaced by a single rod or by a greater plurality of rods that are interengaged in the same or a similar or equivalent manner. In addition, the ball and socket arrangement may be replaced by a plate rotatably mounted on or to the front 12 of the suitcase 10 and pivotally secured to the connecting member 36. These as well as further changes and modifications are all intended to be within the scope of the present invention and, therefore, the foregoing description should be construed as illustrative only and not in a limiting sense, the scope of the invention being defined by the following claims.

What is claimed is:

1. An apparatus for facilitating user-controlled steering of an article of luggage as the article is pulled by a user on an along an underlying support surface in a user-selected desired direction, the article of luggage including a top, a front defining a direction in which the article is being pulled, and a bottom oppositely proximate the support surface, said apparatus comprising:

a socket on the front of the article proximate the article bottom;

a ball disposed within said socket for omnidirectional rotation relative to said socket;

an elongated member depending from said ball and extending outwardly from said socket; and a handle carried on a distal end of said elongated member remote from said bail and graspable by a user for applying to the article a pull force concentrated at the lower front of the article so as to advance the article of luggage along an underlying support surface while steering the article through selective user-controlled manipulation of the handle to correspondingly move said member and rotate said ball in and relative to said socket and thereby selectively directionally vary the pull force applied to the article for moving the article in a user-selected desired direction, at least one of said elongated member and said handle including means for rotation of said handle relative to at least a portion of said member about an axis defined by the elongation of said member.

2. The apparatus of claim 1, wherein said member comprises an elongated arm having a distal end carrying said handle and a connecting member having one end attached to said ball and an opposite end pivotally connected to said elongated arm for further enhancing the user-controlled directional variation of the pull force applied to the article of luggage for facilitating the steering of the article of luggage in a user-selected desired direction.

3. The apparatus of claim 2, further comprising retaining means on the front and proximate the top of the article of luggage for releasable engagement with at least one of said handle and said elongated arm so as to releasably secure said elongated member to the front of the article of luggage during periods of non-use of said apparatus.

4. The apparatus of claim 2, wherein said elongated arm comprises a first elongated rod disposed in movably telescoping relation with a second elongated rod on which said handle is carried, said telescoping relationship enabling user-controllable longitudinal extension and contraction of said arm.

5. The apparatus of claim 4, further comprising retaining means on the front and proximate the top of the article of luggage for releasable engagement with at least one of said handle and said elongated arm so as to releasably secure said elongated member to the front of the article of luggage during periods of non-use of said apparatus.

6. The apparatus of claim 2, wherein said connecting member is integral with said ball.

7. The apparatus of claim 2, wherein said connecting member is nonreleasably secured to said ball.

8. An article of luggage having a steering apparatus for user-controlled steering of said article as the article is pulled on and along an underlying support surface, said article comprising:

a plurality of walls defining a closeable compartment for containing items, said walls including a front wall defining a direction of forward movement of the article, a bottom wall, and a top wall;

a plurality of rotatable wheels mounted on the bottom wall of said article in confronting opposition to an underlying support surface for enabling rolling movement of said article on and along the support surface;

a socket on the front wall of said article, said socket being disposed proximate said bottom wall so that pull forces exerted by a user are applied to the article below a center of gravity of said article to thereby minimize tipping of the article when steered by the user along a directionally-varying path;

a ball disposed within said socket for omnidirectional rotation relative to said socket;

an elongated member extending outwardly from said ball; and a handle carried on an end of said elongated member opposite said ball and graspable by a user for pulling the article of luggage along the underlying support surface while steering the article through selective manipulation of said handle so as to move said member and thereby rotate said ball in said socket and correspondingly redirect the article for movement in a desired new direction of travel along the support surface, at least one of said elongated member and said handle including means for rotation of said handle relative to at least a portion of said member about an axis defined by the elongation of said member.

9. The article of claim 8, wherein said member comprises an elongated arm and a connecting member attached to said ball and pivotally connected to said arm for facilitating user-controlled steered redirection of the article through user manipulation of said handle.

10. The article of claim 9, further comprising retaining means on said front wall proximate the top wall for releasably securing at least one of said member and said handle to said front wall during periods of nonuse of said steering apparatus.

11. The article of claim 9, wherein said arm comprises a first rod in telescoping relation with a second rod on which said handle is carried, for selective relative longitudinal extension and contraction of said rods.

12. The article of claim 10, wherein said member further comprises a first rod in telescoping relation with a second rod on which said handle is carried, for selective relative longitudinal extension and contraction of said rods.

13. The article of claim 9, wherein said connecting member is integral with said ball.

14. The article of claim 9, wherein said connecting member is nonreleasably secured to said ball.

15. An article of luggage having a steering apparatus for user-controlled steering of said article as the article is pulled on and along an underlying support surface, said article comprising:

a plurality of walls defining a closeable compartment for containing items, said walls including a front wall defining a direction of forward movement of the article, a bottom wall, and a top wall;

a plurality of rotatable wheels mounted on the bottom wall of said article in confronting opposition to an underlying support surface for enabling rolling movement of said article on and along the support surface;

a socket on the front wall of said article;

a ball disposed within said socket for omnidirectional rotation relative to said socket;

an elongated member extending outwardly from said ball; a handle carried on an end of said elongated member opposite said ball; said elongated member including an elongated arm and a connecting member attached to said ball and pivotally connected to said arm for facilitating user-controlled steered redirection of the article through user manipulation of said handle, said arm having a first rod in telescoping relation with a second rod on which said handle is carried, for selective relative longitudinal extension and contraction of said rods; and said handle being graspable by a user for pulling the article of luggage along the underlying support surface while steering the article through selective manipulation of said handle so as to move said member and thereby rotate said ball in said socket and correspondingly redirect the article for movement in a desired new direction of travel along the support surface, at least one of said elongated member and said handle including means for rotation of said handle relative to at least a portion of said member about an axis defined by the elongation of said member.

16. An article of luggage having a steering apparatus for user-controlled steering of said article as the article is pulled on and along an underlying support surface, said article comprising:

a plurality of walls defining a closeable compartment for containing items, said walls including a front wall defining a direction of forward movement of the article, a bottom wall, and a top wall;

a plurality of rotatable wheels mounted on the bottom wall of said article in confronting opposition to an underlying support surface for enabling rolling movement of said article on and along the support surface;

a socket on the front wall of said article;

a ball disposed within said socket for omnidirectional rotation relative to said socket;

an elongated member extending outwardly from said ball, a handle carried on an end of said elongated member opposite said ball; said member including an elongated arm and a connecting member attached to said ball and pivotally connected to said arm for facilitating user-controlled steered redirection of the article through user manipulation of said handle, said member further including a first rod in telescoping relation with a second rod on which said handle is carried, for selective relative longitudinal extension and contraction of said rods;

said handle being graspable by a user for pulling the article of luggage along the underlying support surface while steering the article through selective manipulation of said handle so as to move said member and thereby rotate said ball in said socket and correspondingly redirect the article for movement in a desired new direction of travel along the support surface, at least one of said elongated member and said handle including means for rotation of said handle relative to at least a portion of said member about an axis defined by the elongation of said member; and retaining means on said front wall proximate the top wall for releasably securing at least one of said member and said handle to said front wall during periods of nonuse of said steering apparatus.

* * * * *